US008915007B1

(12) United States Patent
Williams

(10) Patent No.: US 8,915,007 B1
(45) Date of Patent: Dec. 23, 2014

(54) CARTRIDGE MAGAZINE LOADER

(71) Applicant: Jerry Williams, Palmdale, CA (US)

(72) Inventor: Jerry Williams, Palmdale, CA (US)

( * ) Notice: Subject to any disclaimer, the term of this patent is extended or adjusted under 35 U.S.C. 154(b) by 0 days.

(21) Appl. No.: 13/999,174

(22) Filed: Jan. 22, 2014

(51) Int. Cl.
*F41A 9/84* (2006.01)
*F41A 9/83* (2006.01)

(52) U.S. Cl.
CPC ..... *F41A 9/83* (2013.01)
USPC ..... 42/88; 42/87

(58) Field of Classification Search
CPC ..... F41A 9/83; F41A 9/84
USPC ..... 42/87, 88
See application file for complete search history.

(56) References Cited

U.S. PATENT DOCUMENTS 6,810,616 B2 11/2004 Tal
7,059,077 B2 6/2006 Tal et al.
7,503,138 B2 3/2009 Tal
7,637,048 B2 12/2009 Tal
7,805,874 B2 10/2010 Tal

OTHER PUBLICATIONS

Maglula Ltd; Tools for loading and unloading magazines; Web Page, www.maglula.com/RiflemagLoaders/BenchLoader; Dec. 24, 2013; 2 pages.

*Primary Examiner* — Daniel J Troy
(74) *Attorney, Agent, or Firm* — Dennis W. Beech

(57) ABSTRACT

A magazine loader has an elongated bar shape with a top wall and four subtending side walls with a recessed portion in the top wall relative to the plane of the top wall. The recessed portion has an open top cartridge channel in a first portion with two opposed horizontal flanges that extend the length of two side walls, and an open top magazine cavity in a second portion with a bottom wall, three upstanding side walls, and a follower projecting member. The follower projecting member is positioned to fit between opposed retaining clips of a magazine to partially depress a follower. The cartridge channel at a first end has an inclined portion sloped from the top wall to a bottom wall. A strip of sticky tape material attached to a row of cartridges may be used to pull the cartridges through the cartridge channel and into the magazine.

11 Claims, 3 Drawing Sheets

CARTRIDGE MAGAZINE LOADER

BACKGROUND OF THE INVENTION

This invention relates to devices and methods for loading cartridges into magazines for use with rifles. The new cartridge magazine loader allows loading of a magazine with multiple cartridges that are positioned side-by-side and retained by one or two strips of sticky tape material.

Various types of cartridge, round, or ammunition loaders are known in the art as is demonstrated in the prior art summary of U.S. Pat. No. 7,059,077, issued on Jun. 13, 2006. The loaders may be for rounds bound with a metal or plastic retainer strip or for loading of loose rounds such as disclosed in the U.S. Pat. No. 7,059,077 patent. However, there is a need for a simple, multi-cartridge loader that can be used to facilitate the loading of cartridges that may be individually packaged in bulk containers positioned in rows by stacking, positioned in rows in Styrofoam holders, laid in ammunition containers or ammo cans, or otherwise unbound cartridges generally positioned in rows side-by-side that require loading in a cartridge magazine for use with a firearm such as a rifle.

SUMMARY OF THE INVENTION

The present invention is directed to devices for loading cartridges into magazines for firearms. A body may have an elongated bar shape with a top wall and four subtending side walls with an elongated open top channel formed in the top wall as a recessed portion relative to the plane of the top wall. The recessed portion has an open top cartridge channel in a first portion with a longitudinal bottom wall, two opposed upstanding longitudinal side walls, and two opposed generally horizontal flanges that extend the length of the side walls. The side walls and flanges are structured to form a first groove with the bottom wall to receive a cylinder casing of a cartridge on an end portion thereof and to form a second groove with the bottom wall to receive a bullet of the cartridge on an end portion thereof. The recessed portion has an open top magazine cavity in a second portion with a bottom wall and three upstanding side walls that are spaced apart to receive a designated size magazine for retention by the three side walls and a follower projecting member attached to one of the two opposed upstanding longitudinal side walls adjacent a juncture of the magazine cavity and the cartridge channel. The follower projecting member is positioned to fit between opposed retaining clips of the designated size magazine to partially depress a follower. The cartridge channel at a first end has an inclined portion sloped from the top wall to the bottom wall of the cartridge channel.

These and other features, aspects and advantages of the present invention will become better understood with reference to the following drawings, description and claims.

DETAILED DESCRIPTION

Figure 1:
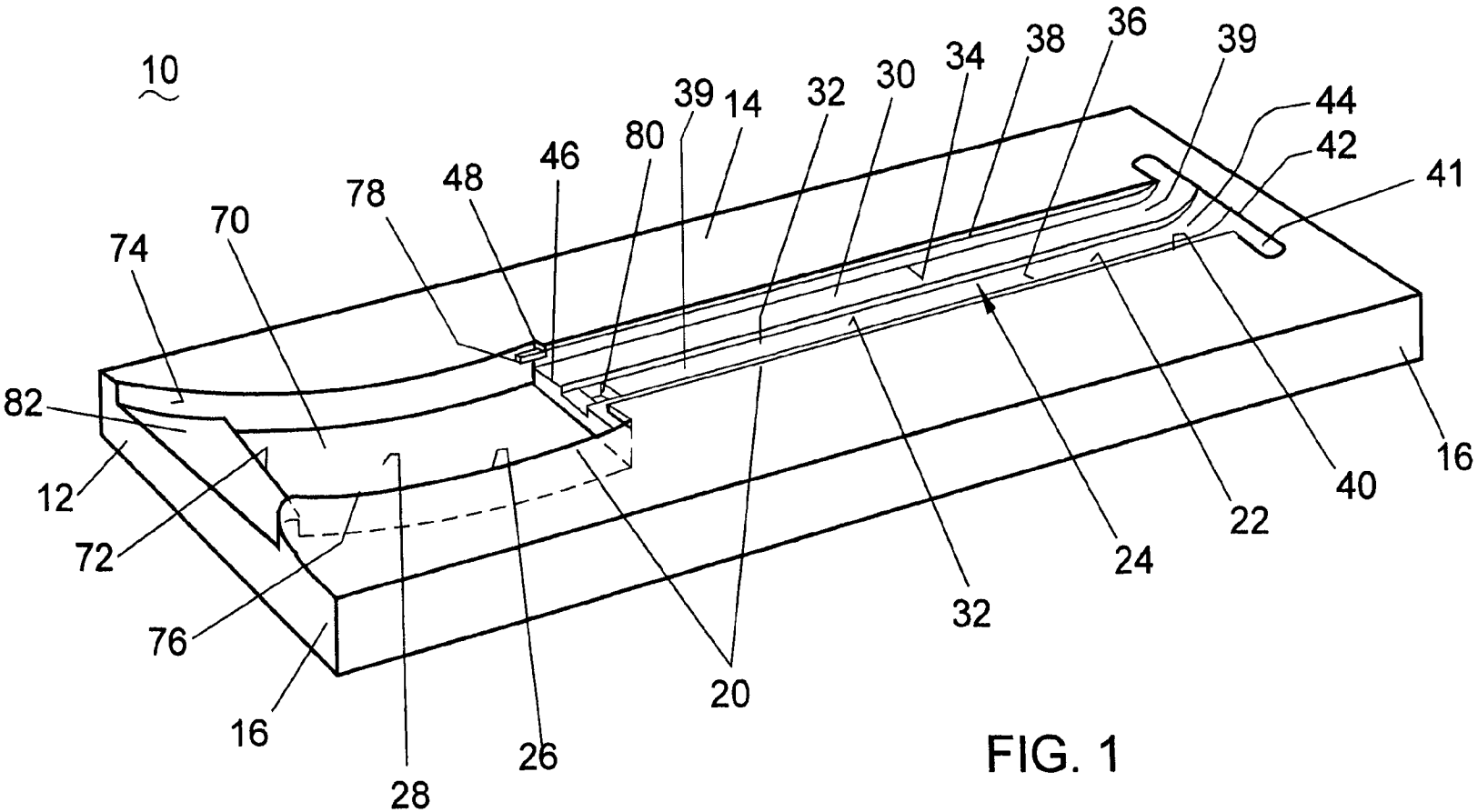
FIG. 1 illustrates a perspective view of a cartridge magazine loader according to an embodiment of the invention.
Figure 2:
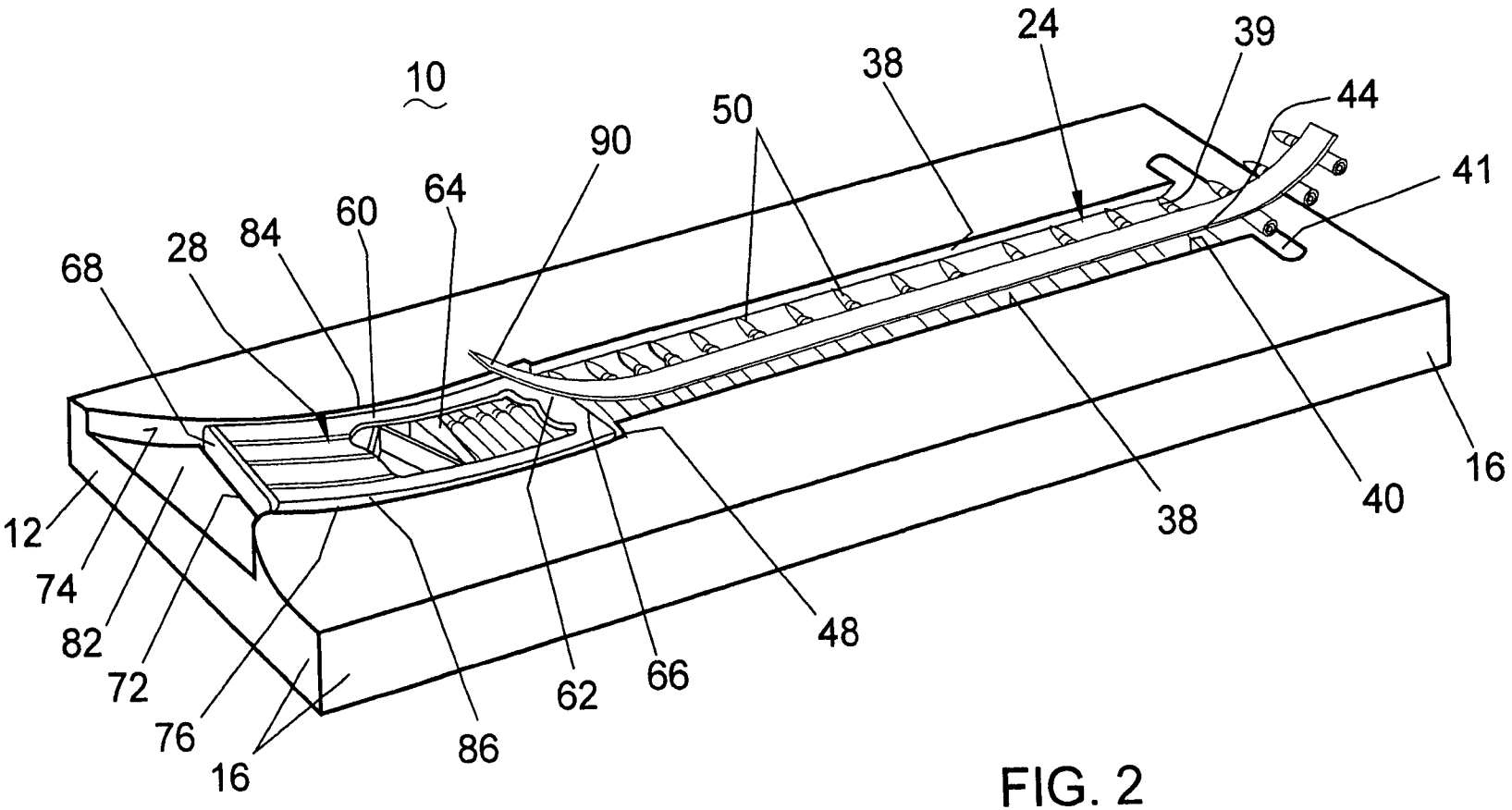
FIG. 2 illustrates a perspective view of a cartridge magazine loader with a magazine and cartridges positioned therein according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4A, a magazine loader 10 for loading cartridges 50 into a magazine 60 has a body 12 structure of an elongated bar shape that may be molded of a generally rigid polymer material. The body 12 may have a top wall 14 with four subtending side walls 16. An elongated open top channel 20 is formed in the top wall 14 as a recessed portion relative to the surface 18 or plane of the top wall 14.

The channel 20 has a first portion 22 that is an open top cartridge channel 24 and a second portion 26 that is an open top magazine cavity 28. The cartridge channel 24 has a longitudinal bottom wall 30 with a lower recess channel 32 the length of the bottom wall 30, two opposed upstanding longitudinal side walls 34 and 36, and two opposed generally horizontal flanges 38, 40 that may be rims or elongated, straight extension portions of the top wall 14 that are approximately parallel to the bottom wall 30 that extend the length of the side walls 34, 36. A first side wall 34 and flange 38 are structured to form a groove 39 with the bottom wall 30 sized to receive a cylinder casing 52 of a cartridge 50 on an end portion 54 and a second side wall 36 and flange 40 are structured to form a groove 41 with the bottom wall 30 sized to receive a bullet 56 of a cartridge 50 on an end portion 58 or tip. The flanges 38, 40 may extend or project outwardly from the two opposed side walls 34, 36 a distance to retain cartridges 50 at each end when they are slidably positioned in the cartridge channel 24. Depending on the size or length of a cartridge 50 the extension may be approximately one half inch. The flange 38 that is over the bullet 56 element of a cartridge 50, see FIG. 4, may have a thickness greater than the opposed flange 40 to position it in the cartridge channel 24.

The magazine cavity 28 has a bottom wall 70 and three upstanding side walls 72, 74, 76 that are sized and spaced apart to receive a designated size magazine 60 to be retained by the three side walls 72, 74, 76 and by one or two follower projecting members 78 attached to one or both of the two opposed side walls 74 and 76 adjacent the juncture 48, joint or intersection of the magazine cavity 28 with the cartridge channel 24. The projecting members 78 are structured and positioned to fit between opposed retaining clips 62 of the magazine 60 to partially depress the follower 64 against its spring force without extending outward so far to interfere with cartridge 50 insertion in the magazine 60 from the cartridge channel 24. For example, the projecting member 78 may be positioned for a bullet 56 of the cartridge 50 to slide under. The projecting members 78 aid in inhibit movement of the magazine 60 as cartridges 50 are inserted into the magazine 60.

The cartridge channel 24 at its first end 42 has an incline portion 44 sloped from the top wall 14 to the bottom wall 30 of the cartridge channel 24. This allows cartridges 50 to be moved from the level of the top wall 14 to move under the two opposed horizontal flanges 38, 40 to then be moved to the second end 46 at the juncture 48 of the cartridge channel 24 with the magazine cavity 28 for insertion in the magazine 60. The second end 46 and juncture 48 are sized for ease of communication and continuation between the cartridge channel 24 and a magazine 60 inserted in the magazine cavity 28 with the open follower end 66 positioned at the juncture 48 for ease of loading cartridges 50 in the magazine 60.

Figure 3:
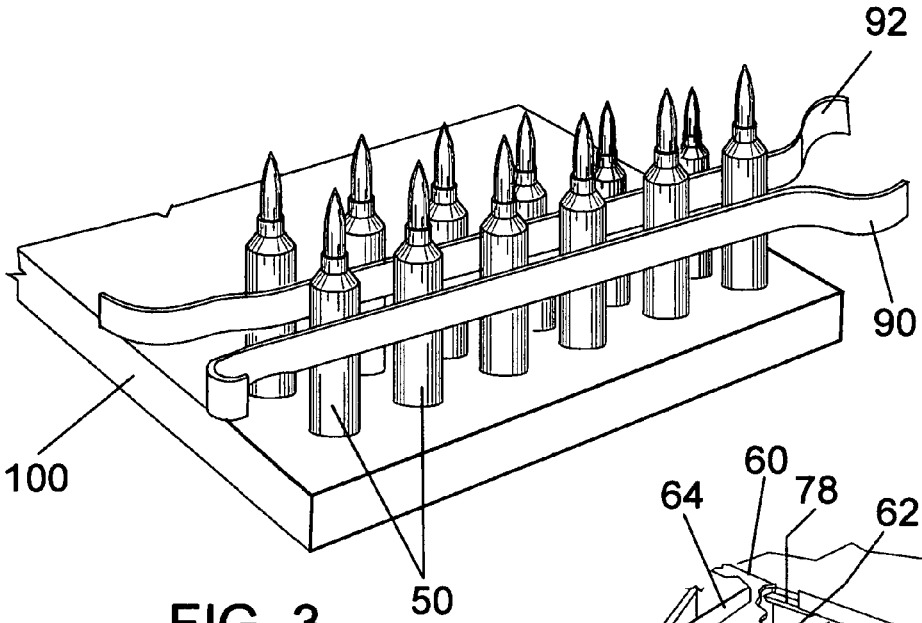
FIG. 3 illustrates a perspective view of a cartridge package packing configuration with a tape strip applied to a row of cartridges according to an embodiment of the invention.
Figure 4A:
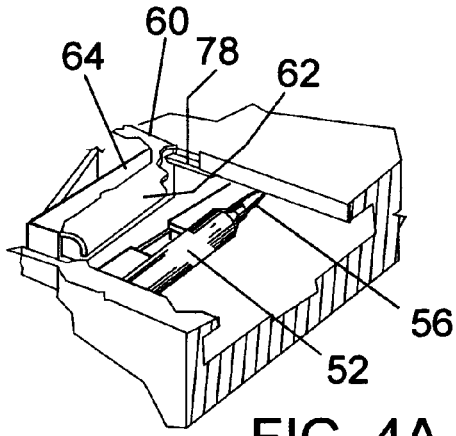
FIG. 4A illustrates a portion of the FIG. 4 view of a magazine loader with a magazine inserted and a follower partially depressed in the magazine according to an embodiment of the invention.
Figure 4:
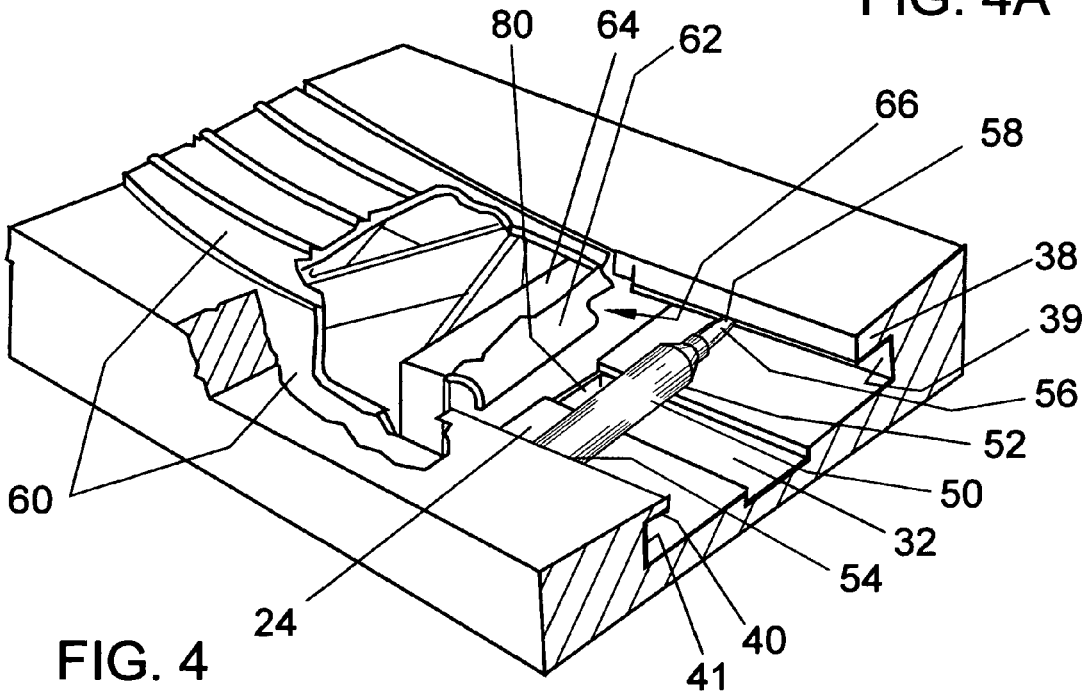
FIG. 4 illustrates a portion of a top plan view of a magazine loader with a magazine inserted and a follower partially depressed in the magazine according to an embodiment of the invention.

A strip of sticky tape material 90 may be used to temporarily attach a row of cartridges 50 to be aligned side-by-side with the casings 52 adjacent and the bullets 56 adjacent and aligned, see FIG. 3. FIG. 3 is an example of a block of packing material 100 that may be formed of Styrofoam, paperboard or the like with holes for insertion of the casings 54 of cartridges 50 during packaging. For purposes of this disclosure the cartridge 50 has a cylindrical casing 52 containing a charge for a firearm and a primer, and a bullet 56. The tape strip 90 may be applied to the casings 52 to move the row of cartridges 50 from the packing material 100 to then use the tape strip 90 to slide the row of cartridges 50 down the inclined portion 44 of the cartridge channel 24 to position the row of cartridge in the grooves 39, 41 in the cartridge channel 24. The tape strip 90 may then be used to pull the cartridges 50 into the magazine 60 and remove the tape strip 90 over the top of the magazine 60.

A tape opening 80 may be formed in the juncture 48. A second tape strip 92 may be engaged with the row of cartridges 50 in FIG. 3. When a row of cartridges 50 is slid into the cartridge channel, one of the two opposed tape strips 90, 92 may have an end inserted into the tape opening 80 and the first tape strip used with the second tape strip to pull the cartridges 50 into the magazine.

The magazine cavity 28 may have side walls 74, 76. One or both of the side walls 74, 76 may be formed to allow space between a portion of a side wall 74, 76 and a side wall 84, 86 of a magazine 60 for a person to engage a magazine 60 inserted in the magazine cavity 28. The end wall 72 of the magazine cavity 28 may be formed to allow space or an access recess portion 82 at the end wall 72 and the closed end 68 of the magazine 60 to allow finger access to the closed end 68. The abutting of the closed end 68 against the end wall 72 when the magazine 60 is inserted in the magazine 60 cavity 28 slightly depresses the follower 64 against the follower projecting member 78 to aid in retaining the magazine 60 in the magazine loader 10.

The combination of structural elements allows for a one piece structure without moving parts for use in loading cartridges in a magazine. The forming of a magazine loader 10 allows for a cost effective cartridge magazine loader for use by individuals for a variety of firearm operational conditions.

While the invention has been particularly shown and described with respect to the illustrated embodiments thereof, it will be understood by those skilled in the art that the foregoing and other changes in form and details may be made therein without departing from the spirit and scope of the invention.

I claim:

1. A magazine loader for loading cartridges into a magazine comprising:

a body having an elongated bar shape with a top wall and four subtending side walls with an elongated open top channel formed in said top wall as a recessed portion relative to the plane of said top wall;

a first portion of said recessed portion is an open top cartridge channel with a longitudinal bottom wall, two opposed upstanding longitudinal side walls, and two opposed generally horizontal flanges spaced apart from said bottom wall that extend the length of said side walls;

a first side wall and a first flange of said two side walls and said two flanges are structured to form a first groove with said bottom wall sized to receive a cylinder casing of a cartridge on an end portion thereof, and a second side wall and a second flange are structured to form a second groove with said bottom wall sized to receive a bullet of said cartridge on an end portion thereof;

a second portion of said recessed portion is an open top magazine cavity with a bottom wall and three upstanding side walls that are spaced apart to receive a designated size magazine for retention by said three side walls and a follower projecting member attached to one of said two opposed upstanding longitudinal side walls adjacent a juncture of said magazine cavity and said cartridge channel;

said follower projecting member is disposed to fit between opposed retaining clips of said designated size magazine to partially depress a follower; and said cartridge channel at a first end has an inclined portion sloped from said top wall to said bottom wall of said cartridge channel.

2. The magazine loader as in claim 1 wherein:

a lower recess channel is formed in said bottom wall that is the length of said bottom wall; and said magazine cavity bottom wall and said cartridge channel bottom wall have a generally rectangular aperture formed therein at an end of said lower recess channel.

3. The magazine loader as in claim 1 wherein said two horizontal flanges project outwardly from said two opposed side walls above said bottom wall of said first portion approximately one half inch.

4. The magazine loader as in claim 1 wherein said two opposed upstanding longitudinal side walls of said first portion are an elongated, parallel straight form.

5. The magazine loader as in claim 1 wherein:

two side walls of said three upstanding side walls are opposed, spaced apart, and curved;

an end wall of said three upstanding side walls is disposed between said two side walls opposed to said juncture; and wherein said end wall has an access recess portion.

6. A method for loading cartridges into a magazine using the magazine loader as in claim 1 comprising:

attaching a strip of sticky tape material to a plurality of cartridges that are aligned side-by-side with the casings and the bullets of each of said cartridges adjacent and aligned;

moving the plurality of cartridges with the tape strip to the inclined portion of the magazine loader;

sliding the plurality of cartridges down the inclined portion of the cartridge channel to position the plurality of cartridges in the grooves in the cartridge channel; and pulling the plurality of cartridges using the tape strip into the magazine and removing the tape strip over the top of the magazine.

7. The method as in claim 6 wherein the tape strip is applied to each casing for attachment.

8. The method as in claim 6 wherein said plurality of cartridges is disposed in rows in a body of packing material.

9. The method as in claim 6 wherein said plurality of cartridges is disposed in rows of cartridges in an ammunition container.

10. The method as in claim 8 wherein a second strip of sticky tape material is attached to said plurality of cartridges opposed to said strip of sticky tape.

11. The method as in claim 6 wherein inserting a designated size magazine against an end wall of said magazine cavity causes a friction force between said designated size magazine closed end and said end wall based on said follower spring force against said follower projecting member.

* * * * *